United States Patent [19]

George

[11] Patent Number: 4,529,501

[45] Date of Patent: Jul. 16, 1985

[54] HYDRODESULFURIZATION OF COKE

[75] Inventor: Zacheria M. George, Edmonton, Canada

[73] Assignee: Research Council of Alberta, Edmonton, Canada

[21] Appl. No.: 614,485

[22] Filed: May 29, 1984

Related U.S. Application Data

[63] Continuation-in-part of Ser. No. 274,876, Jun. 18, 1981, abandoned.

[30] Foreign Application Priority Data

Jul. 3, 1980 [CA] Canada ..... 355403

[51] Int. Cl.[3] ..... C10G 9/32; C10G 9/14

[52] U.S. Cl. ..... 208/127; 208/131

[58] Field of Search ..... 208/127, 131

[56] References Cited

U.S. PATENT DOCUMENTS

| | | | |
|---|---|---|---|
| 2,950,245 | 8/1980 | Thomsen | 208/348 |
| 3,179,584 | 4/1965 | Hamner et al. | 208/127 |
| 3,298,947 | 1/1967 | Gray | 208/127 |
| 3,387,941 | 6/1968 | Murphy et al. | 423/461 |
| 3,472,622 | 9/1966 | Ridley | 423/461 |
| 3,923,635 | 12/1975 | Schulman et al. | 208/127 |
| 4,003,823 | 1/1977 | Baird, Jr. et al. | 208/11 A |
| 4,049,538 | 9/1977 | Hayashi et al. | 208/125 X |
| 4,305,809 | 12/1981 | Chen et al. | 208/226 X |

*Primary Examiner*—D. E. Gantz
*Assistant Examiner*—Glenn A. Caldarola
*Attorney, Agent, or Firm*—Sim & McBurney

[57] ABSTRACT

The extent of hydrodesulfurization of coke formed by coking bitumen is enhanced by the addition of small amounts of sodium hydroxide to the bitumen prior to coking the same.

4 Claims, No Drawings

HYDRODESULFURIZATION OF COKE

REFERENCE TO RELATED APPLICATION

This application is a continuation-in-part of pending U.S. patent application Ser. No. 274,876 filed June 18, 1981, now abandoned.

FIELD OF INVENTION

The present invention relates to the removal of sulphur as hydrogen sulphide from coke formed in upgrading procedures for bituminous oils.

BACKGROUND TO THE INVENTION

Bitumen which is extracted from oil sands by the commercial "hot water" process as practised in the Athabasca region of Alberta, Canada contains about 4.5 wt.% sulphur and a variable proportion, up to about 20%, asphaltenes.

The bitumen is subjected to upgrading operations to form a synthetic crude oil. The initial step of such upgrading operation is to subject the bitumen to a coking step, which involves evaporating off volatiles from the bitumen to leave a solid carbonaceous material, known as "coke". The quantity of coke may vary, and is usually in the range of about 10 to 20 wt.% of the bitumen.

The coke so formed contains the asphaltenes fraction of the bitumen and also has a high sulphur content, usually about 5.5 to 6 wt.%, almost entirely of organic nature. The sulphur content of the coke inhibits its direct use as a source of thermal energy and it has previously been suggested to decrease the sulphur content of coke by reaction with hydrogen to convert the sulphur to hydrogen sulfide, and in this way render the coke more suitable for use as a fuel.

In a direct hydrodesulfurization process, the sulphur-containing coke is heated in a hydrogen stream to remove the sulphur but the extent of desulfurization obtained in this manner is usually quite poor. Such conventional hydrodesulfurization process is described, for example, in U.S. Pat. No. 3,472,622.

In my prior Canadian Pat. No. 1,098,464, there is described a process for improving the degree of desulfurization attained wherein the coke is impregnated with sodium hydroxide solution and dried prior to the hydrodesulfurization. The hydrodesulfurization is effected in a flow of hydrogen at about 700° C. for about 2 hours. The sodium hydroxide, which is typically added in an amount of about 2 to 3 wt.%, appears to act catalytically and may be recovered by leaching following completion of the hydrogenation. The procedure results in over 80% of the initial sulphur being removed primarily as hydrogen sulfide.

The process of the prior invention is limited to coke which is formed by the so-called "fluid coking" process which is a continuous coking operation wherein the bitumen is sprayed onto a hot fluidized bed of coke particles maintained at a temperature of about 900° F. (about 475° C.). However, a so-called "delayed coking" process also is known for coking bitumen. The latter procedure is a batch one which involves heating the bitumen in coking drums at a temperature of about 800° F. (425° C.). The prior process is ineffective in removing sulphur from the resulting coke.

It has also previously been suggested to use sodium hydroxide oil treatment for other purposes. For example, in U.S. Pat. No. 3,179,584, it has been suggested to add sodium hydroxide or other alkali compound to oil prior to coking the same in order to increase hydrogen production. Quantities of alkali compound used range between about 1 to 20 wt.%, and where sodium hydroxide is specifically employed, a concentration of 5 wt.% is specified. This prior art is not in any way concerned with hydrodesulfurization and sulfur-containing oils are not specifically disclosed.

SUMMARY OF INVENTION

In accordance with the present invention, there is provided an improvement in the hydrodesulfurization of sulphur-containing coke derived from sulfur-bearing bitumen which permits proportions of sulphur greater than the prior procedure of the aforementioned Canadian patent to be removed and which is applicable to coke which is formed both by fluid coking and delayed coking processes. The improvement resides in the addition of a very small amount of sodium hydroxide, in the range of about 0.3 to about 0.8 wt.%, to the bitumen prior to coking.

GENERAL DESCRIPTION OF INVENTION

It has been found that the addition of this minor catalytic amount of sodium hydroxide to the bitumen prior to delayed coking enables close to 85% of the sulphur to be removed from the coke on subsequent hydrodesulfurization.

The hydrodesulfurization step is effected on the coke under conventional hydrodesulfurization conditions using a flowing hydrogen stream, typically at a temperature of about 650° to 725° C., for a suitable period of time, such as about 2 hours. In addition to hydrogen sulfide, the product gas stream may also contain some carbon monoxide, methane, carbon dioxide and water.

The quantities of sodium hydroxide used in the procedure of this invention vary from about 0.3 to about 0.8 wt.% NaOH, preferably about 0.4 to about 0.5 wt.% NaOH. The quantities used, therefore are much lower than in the prior invention described in my aforementioned Canadian patent and in the improved hydrogen yield process of U.S. Pat. No. 3,179,584.

The addition of the sodium hydroxide to the bitumen in this invention does not appear to adversely affect the quality and yield of the liquid and solid products resulting from the coking operations.

EXAMPLES

EXAMPLE 1

50 g of oil sands bitumen was mixed with 10 ml of 1M sodium hydroxide solution and subjected to delayed coking by heating the mixture at a rate of 20° to 30° C. per minute to a coking temperature of about 430° to 475° C. and maintaining the coking temperature for 60 minutes during which substantially all the volatiles from the bitumen were driven off.

The solid coke residue left was about 13 to 14 wt.% of the bitumen and had a sulphur content of about 6 wt.%, corresponding substantially to commercial tar sands delayed coke. The resulting coke was pulverized to about +60-30 mesh particles and 5 g of coke powder was charged to a fixed bed reactor and a hydrogen flow of 120 ml/min was initiated through the reactor. The reactor was heated and a reaction temperature of about 700° C. was reached in about 40 minutes. Hydrogen flow was continued at the reaction temperature for a further 1 hour and 20 minute period at which time the furnace was turned off and the sample allowed to cool in a hydrogen stream.

The reactor was equipped with a valve for sampling the feed and product streams for analysis by gas chromatography using a calibrated thermal conductivity detector with helium as the carrier gas. The products of the hydrodesulfurization were analyzed to be carbon monoxide, methane, carbon dioxide, hydrogen sulfide and water and a weight loss of approximately 10% occurred as a result of the production of these gases.

The extent of desulfurization was determined by two independent methods. The first method involved analysis by gas chromatography of the product stream. Samples were taken at 7-minute intervals, the partial pressure of hydrogen sulfide in the product gas stream was determined at each interval as a function of the hydrogen sulfide chromatographic peak area, the values were plotted against time, and the extent of desulfurization was determined by integrating the area under the curve. By this procedure, 92% desulfurization was determined to have occurred by the production of hydrogen sulfide gas.

The second method of determination involves high temperature combustion of the hydrodesulfurized coke. Following completion of the hydrodesulfurization, the coke is leached with hot water at 80° C. to remove residual alkaline agent, this treatment also removing any sodium sulfide produced during desulfurization. The coke then was dried at 100° C. for 3 hours. For the analysis, 0.3 g sample of the leached and dried coke was placed in a boat between layers of alumina and burned in a stream of oxygen at 1000° C. During the combustion, the sulfur in the coke is oxidized to form gaseous sulfur dioxide which is converted to sulfuric acid in a trap containing 1% aqueous hydrogen peroxide solution. The sulfuric acid was titrated to pH 4.5 using 0.05M sodium hydroxide and the volume of sodium hydroxide added was used to determine the amount of sulfur retained in the sample after the hydrodesulfurization reaction. The initial sulfur content of the coke was also determined in this manner.

The desulfurization was determined by this procedure to be 85% and the close agreement of this value to that obtained by the chromatographic method indicates that sulfur removal was effected primarily by the production of hydrogen sulfide.

EXAMPLE 2

The procedure of Example 1 was repeated with the addition of 0.5 wt.% NaOH to oil sands bitumen. Coking was effected at 480° C. and the yield of coke amounted to 13 wt.% of the bitumen. The coke was ground to +60-29 mesh particle and hydrodesulfurized in a flowing hydrogen stream of 100 ml $H_2$/min at 700° C. The desulfurized coke contained 1.3 to 1.5 wt.% sulfur, indicating 75 to 80% desulfurization.

SUMMARY OF DISCLOSURE

In summary of this disclosure, the present invention provides an improved procedure for the hydrodesulfurization of coke formed from bitumen by delayed or fluid coking techniques to result in coke having a decreased sulphur content and a greater utility as a source of heat. Modifications are possible within the scope of this invention.

What I claim is:

1. A method for the production of coke having a decreased sulfur content, which comprises:

adding sodium hydroxide to a sulfur-containing bitumen in an amount of about 0.3 to about 0.8 wt.% NaOH based on bitumen, coking the bitumen after addition of said sodium hydroxide to form a sulfur-containing coke, and hydrodesulfurizing said coke using a flowing hydrogen stream, said sodium hydroxide being effective to result in removal of at least a major proportion of the sulphur contained in said coke during said hydrodesulfurizing step.

2. The method of claim 1 wherein said amount of sodium hydroxide is about 0.4 to about 0.5 wt.% NaOH.

3. The method of claim 1 wherein said bitumen is bitumen recovered from oil sands and said coking is effected by delayed coking to result in a coke containing about 5.5 to 6 wt.% sulfur.

4. The method of claim 1 wherein said bitumen is bitumen recovered from oil sands and said coking is effected by fluid coking to result in a coke containing about 5.5 to 6 wt.% sulfur.

* * * * *